US008179281B2

(12) United States Patent
Strauss

(10) Patent No.: US 8,179,281 B2
(45) Date of Patent: May 15, 2012

(54) METHOD AND APPARATUS FOR IDENTIFYING CONCEALED OBJECTS IN ROAD TRAFFIC

(75) Inventor: Matthias Strauss, Pfungstadt (DE)

(73) Assignee: Continental Teves AG & Co. oHG (DE)

( * ) Notice: Subject to any disclaimer, the term of this patent is extended or adjusted under 35 U.S.C. 154(b) by 476 days.

(21) Appl. No.: 12/444,778

(22) PCT Filed: Oct. 10, 2007

(86) PCT No.: PCT/EP2007/060788

§ 371 (c)(1),
(2), (4) Date: Apr. 8, 2009

(87) PCT Pub. No.: WO2008/043795

PCT Pub. Date: Apr. 17, 2008

(65) Prior Publication Data

US 2010/0045482 A1 Feb. 25, 2010

(30) Foreign Application Priority Data

Oct. 13, 2006 (DE) ..... 10 2006 049 101
Oct. 10, 2007 (DE) ..... 10 2007 048 809

(51) Int. Cl.
*G08G 1/16* (2006.01)

(52) U.S. Cl. ..... 340/903; 340/905; 340/425.5; 340/436; 701/301

(58) Field of Classification Search ..... 340/903, 340/905, 436, 425.5; 382/103, 104; 701/1, 701/29, 30, 301, 45
See application file for complete search history.

(56) References Cited

U.S. PATENT DOCUMENTS

| | | | | |
|---|---|---|---|---|
| 5,926,114 | A | 7/1999 | Andrews | |
| 5,983,161 | A | 11/1999 | Lemelson et al. | |
| 6,049,295 | A | 4/2000 | Sato | |
| 6,289,332 | B2 * | 9/2001 | Menig et al. | 180/167 |
| 6,553,130 | B1 * | 4/2003 | Lemelson et al. | 382/104 |
| 7,042,345 | B2 * | 5/2006 | Ellis | 340/436 |
| 7,181,343 | B2 | 2/2007 | Mukaiyama | |
| 7,905,314 | B2 * | 3/2011 | Mathevon et al. | 180/274 |
| 2003/0138133 | A1 * | 7/2003 | Nagaoka et al. | 382/104 |

FOREIGN PATENT DOCUMENTS

| | | |
|---|---|---|
| DE | 198 30 547 | 12/1999 |
| DE | 103 56 500 A1 | 7/2004 |
| EP | 0473866 | 3/1992 |
| GB | 2 405 279 A | 2/2005 |
| WO | 1103 34 203 A1 | 3/2005 |

* cited by examiner

*Primary Examiner* — Hung T. Nguyen
(74) *Attorney, Agent, or Firm* — RatnerPrestia

(57) ABSTRACT

Method for detecting concealed objects in road traffic in which the surroundings of a vehicle and movement variables of the driver's vehicle are sensed by sensors, said variables are transmitted as information to vehicles which are located in the surroundings by an interface for vehicle-to-vehicle communication and are received from the vehicles which are located in the surroundings, wherein the following steps are executed:

the data from the sensors expand a surroundings model, the expanded surroundings model is represented in updated form by a display in the driver's vehicle, a situation analysis of the surroundings and an evaluation of the situation are carried out in the driver's vehicle, objects which represent an accident hazard on the display are displayed with a high priority, predefined steps for reducing accident hazard are activated in the driver's vehicle, information relating to the pre-defined steps are transmitted to the surroundings by the communication system.

8 Claims, 3 Drawing Sheets

METHOD AND APPARATUS FOR IDENTIFYING CONCEALED OBJECTS IN ROAD TRAFFIC

CROSS REFERENCE TO RELATED APPLICATIONS

This application is the U.S. national phase application of PCT International Application No. PCT/EP2007/060788, filed Oct. 10, 2007, which claims priority to German Patent Application No. DE 102006049101.7, filed Oct. 13, 2006 and German Patent Application No. DE 102007048809.4, filed Oct. 10, 2007, the contents of such applications being incorporated by reference herein.

BACKGROUND OF THE INVENTION

1. Field of the Invention

The invention relates to a method for detecting concealed objects in road traffic and to a device for carrying out the method.

2. Description of the Related Art

Accidents almost always result from incorrect behaviour by a road user. This incorrect behaviour can have a number of causes:

1.) Lack of experience

2.) A conscious readiness to accept high risk

3.) Failure to notice relevant objects or inattentiveness

4.) Poor visibility

The first three points present the greatest hazards in this context. The fourth point is not considered to have a high hazard potential since in such a situation a road user will be as careful as possible and will otherwise come under point 2. Since points 1 and 2 depend solely on the personal characteristics of the driver, there is very little which can be done about this apart from improved training or more severe sanctions. For the last two points, in the last few decades a large amount of investment has already been made in driver assistance systems which are based on classic surroundings sensor systems such as video sensors or beam sensors. However, these sensors are also subject to restricting factors relating to the sensing range. Such restricting factors, for example objects, fog or snow, can limit the sensing range. In critical traffic situations such as, for example, imminent collisions with other vehicles, a driver frequently cannot react quickly enough or cannot react appropriately for the situation.

EP 0 473 866 A2 discloses a system in which a sensor senses a plurality of potential collision objects and a possible collision is predicted using the acquired data. In order to avoid the collision, it is proposed that braking means and/or steering means be activated by a vehicle control unit in order to avoid a collision. It is not stated how a control unit decides whether the steering means, the braking means or both have to be used in order to avoid the collision.

U.S. Pat. No. 6,049,295 A1 discloses a method which is intended to prevent collisions between vehicles which are travelling through an intersection without road signs or a section of road with poor visibility. This method requires a device which is fixed to the road and in-vehicle devices which are connected to one another by radio.

DE 198 30 547 A1 also discloses an intersection warning system which also relies on road-mounted and vehicle-mounted devices.

The known methods and devices for avoiding a collision use individual driving-situation-typical information items in order to carry out subsequent evaluation for the interpretation of a prevailing driving situation. It is disadvantageous here that other information items cannot be evaluated in a flexible and easy way in order to improve the assessment of the driving situation.

SUMMARY OF THE INVENTION

An object of the invention is to make available a method which overcomes the previous restrictions from the prior art in terms of the sensing of the surroundings and which detects, in particular, concealed objects in road traffic.

In a first refinement of the invention, in the method for detecting concealed objects in road traffic in which, on the one hand, the surroundings of a vehicle and, on the other hand, movement variables of the driver's vehicle are sensed by means of sensors, said variables are transmitted as information to vehicles which are located in the surroundings by means of an interface (17) for vehicle-to-vehicle communication (60) and are received from the vehicles which are located in the surroundings, wherein the following steps are executed:

a) the data from the sensors (10, 20, 30, 40) expand a surroundings model (50), b) the expanded surroundings model (50) is represented in updated form by means of a display (80) in the driver's vehicle, c) a situation analysis (70) of the surroundings and an evaluation of the situation are carried out in the driver's vehicle, d) objects which represent an accident hazard on the display are displayed with a high priority, e) predefined steps for reducing the accident hazard are activated in the driver's vehicle, f) the information relating to the steps which have been initiated in order to reduce the accident hazard are transmitted to the surroundings by means of the communication system (60) for vehicle-to-vehicle communication.

In one advantageous refinement of the method according to aspects of the invention, the information is transmitted by means of multicast and/or unicast and/or broadcast transmission.

One particularly advantageous refinement is defined by the fact that the received information is evaluated with priority and the information which is to be transmitted is transmitted with priority after relevance testing.

The refinement of the method is particularly advantageous in that the received information is passed on to a driver assistance system (14) in the driver's vehicle, and when vehicles which have an activated driver assistance system are detected in the surroundings the transmitted information is fed to the respective driver assistance system of the respective vehicle.

In a further advantageous refinement, predefined steps take place in vehicle 1 for reducing the accident hazard by pretensioning the seatbelts and/or prefilling the brake system of the vehicle.

In one advantageous embodiment of the method according to aspects of the invention, a stereo camera which has a 12-bit dynamic range and performs tracking of objects is used as the visual sensor. As a result, a type of reduction of the quantity of data which is to be evaluated can be carried out during the modification of the surroundings model.

One particularly advantageous refinement of the method according to aspects of the invention is defined by the fact that the transmitted information is provided in the form of position information packets and dynamic information packets (29). The packet-oriented approach allows all the packet-oriented transmission protocols to be addressed.

The object is achieved by means of the inventive device, comprising at least one memory, at least one computer unit (15) and at least one interface (17) for exchanging data, wherein the information from the adjacent vehicles is passed on to the computer unit (15) via the communication system (60) and via the interface (17), the data on the driver's vehicle (1) are determined by means of the sensors (10, 20, 30), updated and passed on to a surroundings model (50) via the sensor data processing means (50), wherein, under real time conditions, the position of the driver's vehicle, the surroundings and the position of the adjacent vehicles are determined by means of the position-determining system (12) and are fed to the computer via the interface (17) with the surroundings model (50), a prediction of the movement path of the driver's vehicle, of the surroundings and of the adjacent vehicles is made on the basis of the information which is received and the data which are determined wherein, when there is a hazard, signalling is carried out to the driver via an output unit (80), or by intervening in the movement path of the driver's vehicle by means of the vehicle safety and/or vehicle assistance systems (13,14) or signalling the intervention in the movement path of the vehicle (1) to the adjacent vehicles.

An exemplary embodiment of the invention is illustrated in the drawings and is described in more detail below.

BRIEF DESCRIPTION OF THE DRAWINGS

In said drawings

DETAILED DESCRIPTION OF THE PREFERRED EMBODIMENTS

Figure 1:
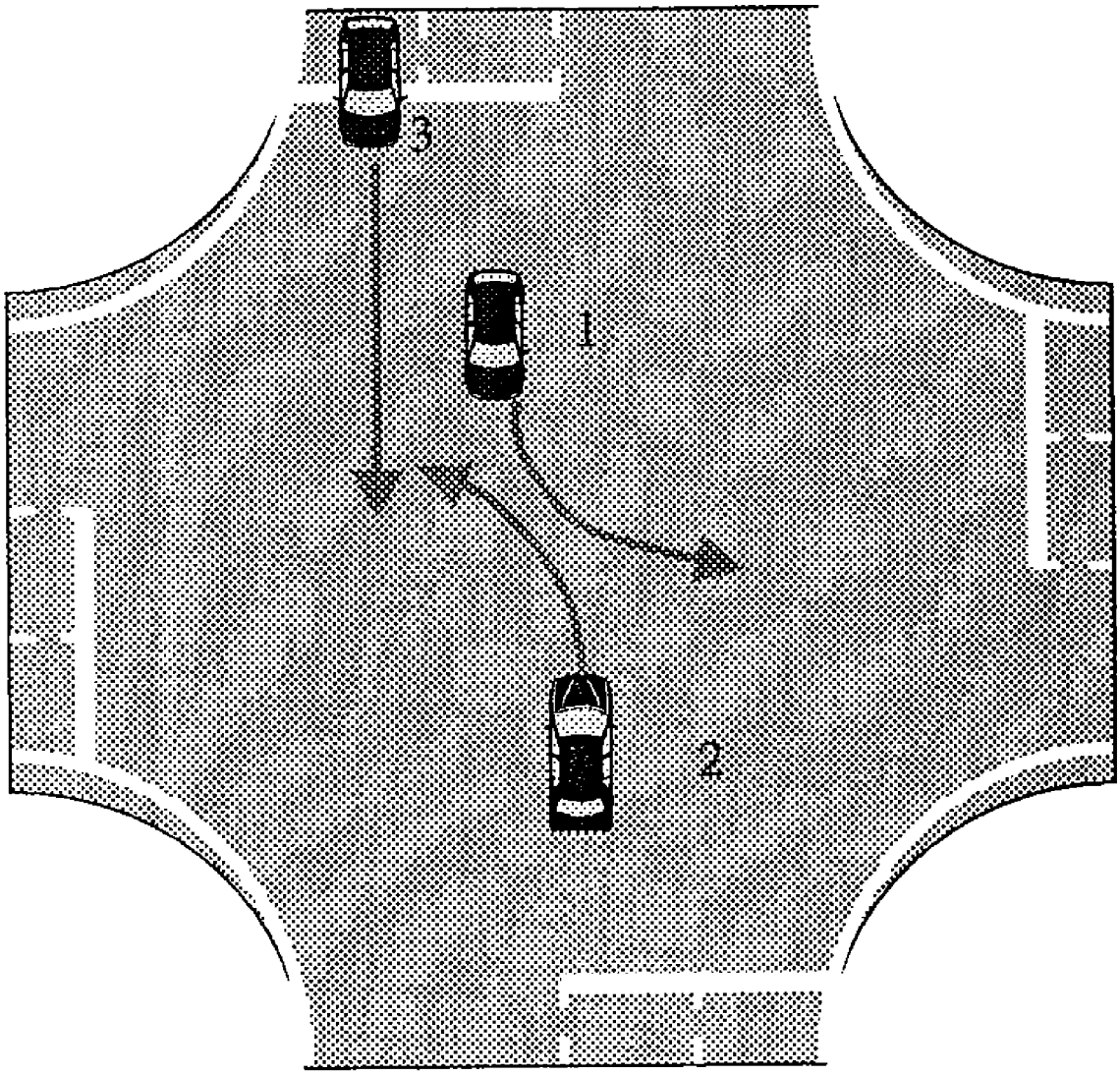
FIG. 1 shows a display representation according to aspects of the invention in the vehicle.

In the vehicle 1 there is at least one communication system 11, position-determining system 12, vehicle safety system 13 or driver assistance system 14 as well as sensors 10, 20, 30 and a sensor data processing means 40, and at least one computer unit 15 with a memory, which computer unit 15 exchanges data with the systems and sensors via wire-bound or mobile data bus lines, wherein a surroundings model 50, the sensor data processing unit 40 and a situation analysis 70 are implemented on the computer unit. The surroundings model 50, the sensor data processing unit 40 and the situation analysis are preferably constructed as modules. The modular concept is represented in the embodiment illustrated in FIG. 1. For example, the exchange of information by means of the communication system 11 is preferably carried out over a mobile radio network such as GSM, and the communication system 60 is used for transmitting and receiving information from vehicle to vehicle. One preferred embodiment contemplates implementing all the communications functionality in a single communication system.

An electronic display which can be viewed by the driver in a positionally fixed and/or variable fashion can be mounted as an output unit in the passenger compartment in the vehicle 80. In order to expand the sensing range both for the driver and for the sensors, a method is used whose sensing range is not restricted by visibility conditions. Such a method is vehicle-to-vehicle communication, as already mentioned. The communication system 60 is configured at least for vehicle-to-vehicle communication. According to aspects of the invention, a standardized system, which supports non-optical, radio-based information transmission methods, is used as the communication system for communication between at least two vehicles or subscribers. The communication system 110 supports different mobile transmission methods which build up an information distribution system in what is referred to as a point-to-point connection, while the communication system 60 implements a broadcast mode. Broadcast or broadcast in a computer-supported network are terms used to refer to the transmission of data packets from one point or vehicle to all the vehicles or users within a network. Information on the surroundings is transmitted with said transmission by means of defined radio standards such as, for example, IEEE 802.11p and is displayed in the driver's vehicle. In hazardous situations, a warning or an intervention into the vehicle behaviour is additionally carried out after the method according to aspects of the invention has been implemented. Different mobile transmission methods such as WLAN, DSRC, GSM, GPRS, UMTS, are implemented by means of the communication system 11 and 60.

Position-determining systems 12 are used to determine the vehicle's own position. Suitable position-determining systems are GPS transmitters and receivers as well as navigation systems. Integrated position-determining systems which combine both functionalities in one device can also be used according to aspects of the invention.

All the brake systems which are available in the vehicle with electronic control can be used as vehicle safety systems 13. Vehicle safety systems can be the electronic brake system (EBS) 131, the engine management system (EMS) 132, anti-lock brake system (ABS) 133, traction control system (TCS), electronic stability program (ESP), electronic differential lock (EDL), transmission control unit (TCU), electronic braking force distribution system (EBDS) and/or engine drag torque controller (EDTC).

Driver assistance systems 14 are electronic supplementary devices in vehicles for assisting the driver in specific driving situations. They often concentrate on safety aspects, but also on increasing the driving comfort. These systems intervene in a partially autonomous or autonomous fashion in the drive, control system (for example for the fuel or brakes) or signalling devices of the vehicle or warn the driver just before or during critical situations by means of suitable man/machine interfaces. Such driving assistance systems are, for example, a parking aid (sensor arrays for detecting obstacles and inter-vehicle distance), a braking assistant (BAS), cruise controller or adaptive cruise controller (ACC) 141, inter-vehicle distance warning device, turning-off assistant, traffic jam assistant, lane detection system, lane keeping assistant/lane assistant (lateral guidance assistance system, lane departure warning (LDW) system) 142, lane keeping support, lane change assistance, lane change support, intelligent speed adaptation (ISA), adaptive light for bends, tyre pressure monitoring system, driver state detection system, road sign detection system, platooning system, automatic emergency braking (AEB) system, headlight assistant for changing them from full beam to dipped setting, night vision system.

Integrating various systems permits all the functional advantages of the individual subsystems to be maintained and in addition their overall performance is improved. While the individual subsystems can reduce accidents by minimizing the risk of certain hazards which apply only to the driver's vehicle, the invention can solve complex hazardous situations in which, in particular, numerous vehicles are involved.

Figure 2:
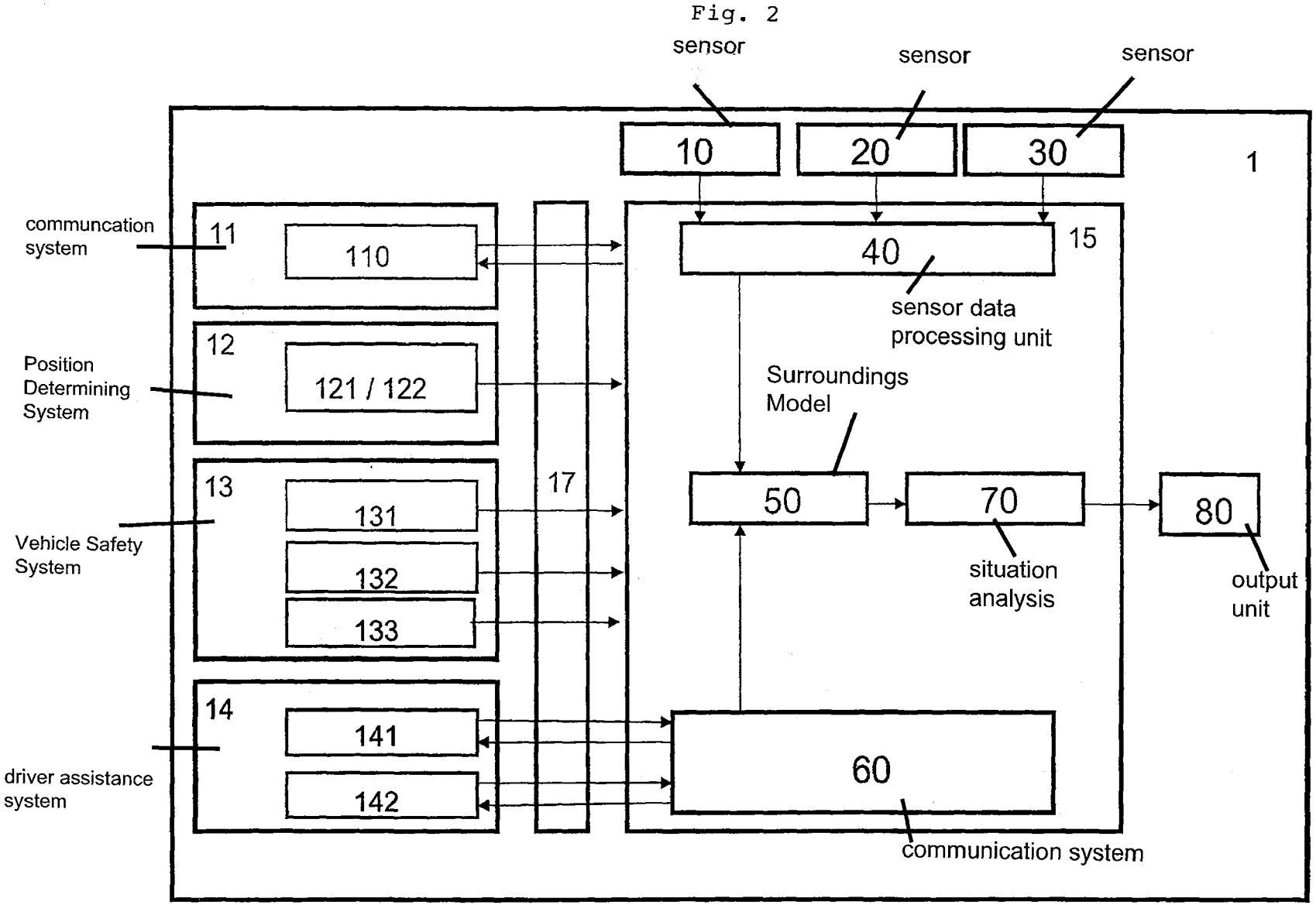
FIG. 2 shows the block circuit diagram according to aspects of the invention.

The structure in FIG. 2 shows a multi-sensor surroundings sensing system with an interconnected surroundings model. The core of the method according to aspects of the invention comprises the steps of the conditioning of sensor data 40, formation and supplementation of the surroundings model 50 by means of the sensor data processing means 40 and the vehicle-to-vehicle communication 60, and the supplying of the surroundings model to a situation analysis means.

The surroundings model 50 has an interface with the vehicle safety system and driver assistance systems and at the same time permits the surroundings sensing process to be checked.

At the start of the method, an inventory is taken of all the usable sensors. This includes both a functional description and all the important performance features of the sensors. Despite the plurality of available sensors, the sensors which are used are divided according to technology into the following three categories: lidar 10 based on scanning or fixed laser beams, and radar 20 with versions for long-range radar and short-range radar and visual sensors embodied as cameras 30, both for the visible range and for the invisible range, which includes, for example, thermal radiation.

A radar system uses electromagnetic waves to measure the distance from, and at the same time the speed of, objects by evaluating the backscattering from the objects. For the generation of the radio waves various possibilities are used such as pulse radar, FMCW (frequency modulated continuous wave) and FSK (frequency shift keying) modulation as well as combinations thereof. A long-range radar is used for the adaptive cruise control (ACC) system, in which radar distances up to 150 metres can be measured and the objects are considered in punctual form.

In the case of short-range radar, a plurality of sensors (transmitters and receivers) which each have a significantly larger angle of aperture (up to +/−60°) are used simultaneously. Through interconnected evaluation of the reception signals it is even possible to determine the location of a plurality of objects up to a distance of 30 metres. While the long-range radar operates at a frequency of 77 GHz, the short-range radar uses the frequency range around 24 GHz or 79 GHz. An important advantage of radar is the lack of sensitivity of the propagation of the radar waves to weather influences such as rain, snowfall or fog.

In contrast to radar, in the case of lidar the speed of the object is usually determined by means of a plurality of distance measurements and not directly by evaluation of the Doppler effect. Non-scanning systems with a plurality of laser beams and photodiodes (multibeam lidar) such as the long-range radar for adaptive cruise control (ACC) are used, in which case the relatively large number of beams permits better lateral resolution compared to the long-range radar. In the short range, use is predominantly made of scanning lidar which in principle permits complete all-round vision (360° angle of aperture). In order to compensate for pitching movements of the vehicle, the use of a plurality of scanning planes is contemplated.

Cameras provide, in contrast to the distance-measuring principles of radar and lidar, a high-resolution image of the driving surroundings. Since the contrast ratios in road traffic are often very large, according to aspects of the invention highly dynamic cameras with, for example, a 12-bit dynamic range are used. While grey value cameras can be used for lane detection, colour cameras are provided for reliable detection of traffic lights. In order to link the 2-D information of a monocamera with distance information, according to aspects of the invention stereo cameras with a horizontal basis, like the pair of eyes of a human being, and determines the disparities between the two images mainly at vertical edges for the determination of distance. Furthermore, according to aspects of the invention it is contemplated to use movable cameras like the scanning approaches of lidar or radar, a significant increase in the viewing angle, with additional control in the viewing direction, for example on the basis of the attentiveness. According to aspects of the invention it is also contemplated to use thermal imaging cameras for the detection of pedestrians since the temperature of the human body constitutes a reliable detection feature.

According to aspects of the invention, the use of the abovementioned sensors permits the disadvantages of the individual sensors in combination with one another to be eliminated and added value is generated by the combined use.

The sensor data conditioning means 40 block takes into account, in a particular way, the additional requirements of a multi-sensor approach. As soon as sensor data are placed in relationship with one another, both the position of the sensors with respect to one another and a common time base with respect to one another are provided. For this purpose, the invention carries out location calibration for determining the geometric relationship between the objects and vehicles, time synchronization for determining the chronological relationship between the objects and vehicles, and sensor modelling, in which sensor properties are taken into account. According to aspects of the invention, it is contemplated to use the driver's vehicle as a reference point for the coordinate system, which vehicle is, of course, appropriately associated with the location-related information, for example from navigation maps or position-determining systems 12.

Since the objects in the traffic surroundings often move at high speed, a common time base is defined for a multi-sensor approach. Stereocameras are, for example, operated synchronously in order to obtain both measurements at the same time. According to aspects of the invention, asynchronous systems are also used if the measurements are provided with a time stamp which is supplied by a common system clock (master clock).

For the radar-lidar camera multisensory system which is used, all the known and required sensor properties are stored in sensor models and then explicitly taken into account in the processing of sensor data since the properties of the individual sensors, such as range, angle of aperture, also have to be efficiently taken into account in the event of changes, for example a different camera lens.

Figure 3:
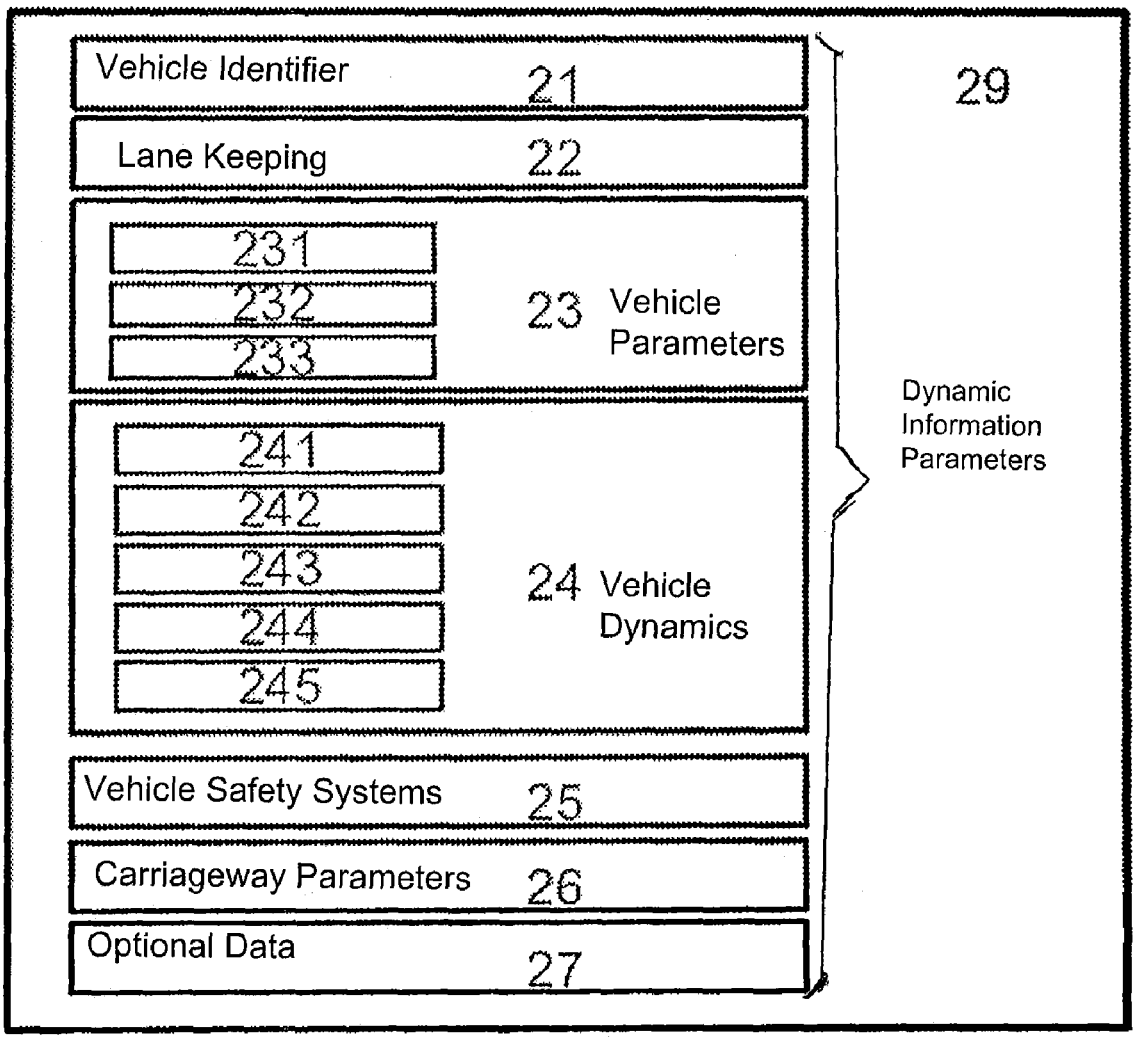
FIG. 3 shows an example of a data model.

In the surroundings model 50, all the results of the multisensor driving surroundings sensing process and the additionally received information from the surroundings are combined by means of the vehicle-to-vehicle communication via the communication system 60. The information from the adjacent vehicles is received and updated in such a way that, as specified by way of example in FIG. 3, the adjacent vehicles 2 and 3 continuously transmit their position information packets and dynamic information packets 29 (PDP) via the communication system which is located in the respective vehicle and is responsible for the exchange of information between at least two vehicles, for the purpose of vehicle-to-vehicle communication.

The distributed position information and dynamic information packets 2 which represent the respective vehicle contain information, for example the vehicle identifier 21, The GPS data with precise information about the lane keeping 22, the individual vehicle parameters 23 such as, for example, the vehicle geometry with length 231, width 232, turning circle, the type of vehicle (passenger car/off-road vehicle/van/lorry etc.) 233, the previously known information on vehicle dynamics 24 with the maximum longitudinal acceleration and maximum longitudinal deceleration 241, maximum lateral acceleration 242, maximum vehicle speed 23, the current vehicle speed 245, the longitudinal acceleration, the lateral acceleration, the current yaw rate, the current steering angle.

Furthermore, the position information packets and dynamic information packets 29 contain information about the vehicle safety systems 25 and vehicle assistance systems 25 which are currently active in the respective vehicle as well as information about the carriageway parameters 26 such as, for example, the camber angle and estimated friction. Further fields are provided in the position information packets and dynamic information packets 2 for optional data 27 such as the state of traffic light signals or the position of detected pedestrians.

The position and dynamic information of all the adjacent vehicles with which the driver's vehicle communicates is stored in a dynamically updated internal memory of the computer unit 15 which can be configured as a database.

If the transmitting vehicle already has an active position information packet and dynamic information packet in the database, i.e. it is already "recognized" by the driver's vehicle which is receiving, the data is updated with the newest position information packet and dynamic information packet.

If the vehicle is currently driving in the communication range, it is input with the original position information packet and dynamic information packet into the data base. The position information packets and dynamic information packets 2 of a vehicle which leaves the zone and which no longer transmits any data after an active time period are removed from the database.

The updating and transmission of the driver's position and dynamic data on the driver's vehicle are carried out in such a way that the same data as described are acquired and calculated in the driver's vehicle, and the entire position data packet and dynamic data packet is transmitted to the adjacent vehicles by the driver's communication system.

The position data of the first position-determining system, which can be embodied as a GPS receiver, are used as basic information. These data are passed on to the surroundings model 50.

The surroundings model 50 comprises, according to aspects of the invention, a plurality of object types which are known in advance and which are structured in what is referred to as an object catalogue in order to describe the driving surroundings.

For each object there are a number of attributes which are measured and determined either with the sensor system, for example the width, height, distance, speed, or else in a very simple embodiment as a look-up table, or in another embodiment they are registered in the already mentioned database, these being the number of the lanes, the assignment of traffic lights and speed restrictions.

In terms of the objects, a distinction is made between static objects, i.e. objects which are part of the infrastructure, such as lanes, road signs or roadside structures and dynamic objects. The description of the movement of dynamic objects is carried out by means of subordinate dynamic models which are formulated relative to object-specific coordinate systems.

Pedestrians or unprotected road users are treated separately since both their detection and the form and dynamic models which are necessary for this, such as variable shape due to arm movements and leg movements, abrupt change of direction are possible and as a result they are significantly more complex than, for example, in the case of vehicles.

The situation analysis 70 defines and describes the relationships between the objects which are found, for example vehicles cutting into a lane or travelling in an alley while the traffic jam assistant is functioning. Depending on the complexity of the driver assistance system, such as inter-vehicle distance display, inter-vehicle distance warning, adaptive cruise controller, traffic jam assistant, emergency braking system, different abstraction levels are formed according to aspects of the invention in the analysis of situations such as distance from the vehicle travelling ahead, taking into account the driver's own speed, situation in terms of people cutting into a lane, possible avoidance manoeuvres. In addition to the data from the sensing of the surroundings, the information from the communication with other vehicles and/or the infrastructure is used. All the available information about the current situation is then stored in the expanded surroundings model and is available to the situation analysis means 70.

The display in the vehicle 80 is either represented directly in the video image or else as a virtual image from the viewing angle, as indicated in FIG. 1 which shows a birdseye view. It is contemplated to input the recognition results such as vehicles or lane markings directly into the image. If no video recordings are available or if the sensing range of other sensors is greater than the camera viewing field, the detected objects are represented in a virtual image.

A display in the vehicle is then provided as illustrated in FIG. 1 if two vehicles 1 and 2 are opposite one another as vehicles which are turning off to the left and one of the two vehicles will not see the oncoming traffic since it is concealed by the other vehicle turning off to the left, in which case the driver of the vehicle 2 would recognize immediately that he cannot turn off.

Since the field of vision is expanded by the method and the decision basis is considerably influenced in many cases, numerous additional variants are possible so that the described exemplary embodiment does not constitute a restriction.

The expanded field of vision advantageously avoids hazardous situations from the outset and therefore minimizes or reduces the requirements made of passive safety systems.

The method makes it advantageously possible to determine, on the basis of a situation analysis, the risk which is presented by an object. If there is then a very high hazard potential, the object is particularly highlighted on the display and measures are initiated to avoid an accident. Such measures are, for example, pretensioning of the seatbelts or prefilling of the brake system. It is also contemplated to output acoustic, haptic and visual instructions to the driver indicating that a hazardous situation is arising. The initiated measures are in turn transmitted via the communication system 60 to the surroundings in order to inform the vehicles located in the surroundings of the initiated measures.

The relevant information is passed on to the driver assistance systems in the vehicles 2 and 3 which are located in the direct surroundings in order to likewise expand their sensing range. This results in a network of vehicles in which the use of an information range for the individual vehicle is highly expanded. The driver of the individual vehicle is not restricted in terms of his actions by the evaluation of the sensing of the surroundings which only has a limited local range. As a result, the driver is informed about the presence of specific local conditions at a specific time, enabling him to advantageously take measures in order to avoid accidents, for example.

While preferred embodiments of the invention have been described herein, it will be understood that such embodiments are provided by way of example only. Numerous variations, changes and substitutions will occur to those skilled in the art without departing from the spirit of the invention. It is intended that the appended claims cover all such variations as fall within the spirit and scope of the invention.

The invention claimed is:

1. A method for detecting concealed objects in road traffic in which surroundings of a driver's vehicle are detected by vehicle sensors including a video camera, and vehicle to vehicle communication, and displayed on a vehicle display to the driver, said method comprising the steps of:

a) generating, by a processor, a surroundings model based upon objects detected by the vehicle sensors and movement variables received from other vehicles during communication, the movement variables indicating location and movement of the other vehicles, b) displaying, on the vehicle display, the generated surroundings model as an aerial map view of the driver's vehicle in relation to locations of the detected objects and locations of the other vehicles if the objects or other vehicles in the surroundings model are outside a field of view of the camera, c) displaying, on the vehicle display, the generated surroundings model as the aerial map view of the driver's vehicle in relation to locations of the detected objects and locations of the other vehicles if video from the video camera is not available, d) displaying, on the vehicle display, video from the camera, if the video from the video camera is available and the objects or other vehicles in the surroundings model are within the field of view of the camera, e) performing, by the processor, a situation analysis of the surroundings, f) displaying, on the vehicle display, the objects and the other vehicles which represent an accident hazard on the display with a high priority, and g) activating, by the processor, predefined steps for reducing the accident hazard in the driver's vehicle.

2. The method according to claim 1, wherein the movement variables are transmitted by multicast transmission, unicast transmission, broadcast transmission, or any combination thereof.

3. The method according to claim 1, wherein the received information is evaluated with priority and the information which is to be transmitted is transmitted with priority after relevance testing.

4. The method according to claim 1, wherein the received information is passed on to a driver assistance system in the driver's vehicle, and when vehicles which have an activated driver assistance system are detected in the surroundings the movement variables are transmitted to the respective driver assistance system of the respective vehicle.

5. The method according to claim 1, wherein the predefined steps for reducing the accident hazard in the vehicle are carried out by pretensioning seatbelts, prefilling brake systems, or both pretensioning the seatbelts and prefilling the brake systems.

6. The method according to claim 1, wherein the sensor is a stereocamera with a 12-bit dynamic range.

7. The method according to claim 1, wherein the movement variables are transmitted in the form of position information packets and dynamic information packets.

8. A device for carrying out the method according to claim 1, comprising at least one memory, at least one computer unit and at least one interface for exchanging data, wherein the information from the vehicles which are located in the surroundings is passed on to the computer unit via the communication system and via the interface, the data on the driver's vehicle are determined by the sensors, updated and passed on to the surroundings model via a sensor data processor, wherein, under real time conditions, the position of the driver's vehicle, the surroundings and the position of the surrounding vehicles are determined by a position-determining system and are transmitted to the computer unit via the interface with the surroundings model, wherein, when there is a hazard, one or more of the following occur: (i) signalling is carried out to the driver via the interface with an output unit, (ii) intervening in the movement path of the driver's vehicle by the vehicle safety systems or the vehicle assistance systems, or (iii) signalling the intervention in the movement path of the vehicle to the adjacent vehicles.

* * * * *